US009157157B2

(12) United States Patent
Robinson

(10) Patent No.: US 9,157,157 B2
(45) Date of Patent: Oct. 13, 2015

(54) COUPLED ELECTROCHEMICAL SYSTEM FOR REDUCTION OF POLYOLS TO HYDROCARBONS

(75) Inventor: J. Michael Robinson, Odessa, TX (US)

(73) Assignee: THE UNIVESITY OF TEXAS SYSTEM, Austin, TX (US)

( * ) Notice: Subject to any disclaimer, the term of this patent is extended or adjusted under 35 U.S.C. 154(b) by 311 days.

(21) Appl. No.: 13/074,117

(22) Filed: Mar. 29, 2011

(65) Prior Publication Data

US 2011/0233054 A1 Sep. 29, 2011

Related U.S. Application Data

(62) Division of application No. 11/517,717, filed on Sep. 8, 2006, now Pat. No. 7,915,470.

(51) Int. Cl.

| | |
|---|---|
| ***C07C 1/02*** | (2006.01) |
| ***C10G 1/00*** | (2006.01) |
| ***C25B 3/00*** | (2006.01) |
| ***C25B 3/04*** | (2006.01) |
| ***C25B 15/08*** | (2006.01) |

(52) U.S. Cl.
CPC .. *C25B 3/04* (2013.01); *C25B 15/08* (2013.01)

(58) Field of Classification Search
CPC ..... C25B 13/00; C07C 1/00; C10G 1/00
USPC ..... 204/237; 585/240, 639, 640, 733; 205/349
See application file for complete search history.

(56) References Cited

U.S. PATENT DOCUMENTS

| | | | | |
|---|---|---|---|---|
| 4,925,540 | A * | 5/1990 | Dhooge | 204/157.42 |
| 5,516,960 | A * | 5/1996 | Robinson | 585/639 |
| 5,855,763 | A * | 1/1999 | Conlin et al. | 205/688 |

* cited by examiner

*Primary Examiner* — Zulmariam Mendez
(74) *Attorney, Agent, or Firm* — Robert W Strozier

(57) ABSTRACT

A coupled electrochemical system for its use is disclosed, where a polyol feed, especially a biomass polyol containing feed is reduced in a reducing solution including HI and a metal ion capable of converting $I_2$ to HI during polyol reduction to hydrocarbon or iodohydrocarbon products and where the metal ions are capable of electrochemical reduction so that the system can be run on a batch, semi-continuous or continuous basis. The system is capable of producing hydrocarbon solvent, fuels and lubricating oils.

11 Claims, 2 Drawing Sheets

COUPLED ELECTROCHEMICAL SYSTEM FOR REDUCTION OF POLYOLS TO HYDROCARBONS

RELATED APPLICATIONS

The present application claims priority to and the benefit of U.S. patent application Ser. No. 11/517,717, filed Sep. 8, 2006, now U.S. Pat. No. 7,915,470, issued 29 Mar. 2011.

BACKGROUND OF THE INVENTION

1. Field of the Invention

The present invention relates to a system for the electrochemical conversion of polyols to hydrocarbon (HC) products and to methods for making and using same.

More particularly, the present invention relates to a regenerable system for the electrochemical conversion of polyols, especially from biomass or other waste products, to hydrocarbon (HC) products such as combustible HC fuels, where the system comprises a coupled electrochemical reduction including a reduction of polyols to hydrocarbons or iodohydrocarbons and a concurrent oxidation of HI to $I_2$. These primary reactions are coupled to a secondary electrochemical reaction that converts $I_2$ back to HI via the oxidation of a metal from a reduced oxidation state to a oxidized oxidation state, e.g., $V^{2+}$ to $V^{3+}$. The system is regenerated by reducing the spent metal from is oxidized state back to its reduced state, e.g., $V^{3+}$ back to $V^{2+}$, providing a continuous electrochemical system for polyol reduction. The invention also relates to a method for converting polyols, in particular polyols derived from biomass, into hydrocarbons that can be burned as fuels.

2. Description of the Related Art

Efficient utilization of biomass as an industrial feedstock will result in a renewable and sustainable resource for chemicals and liquid transport fuels (see, e.g., Chum, H. L.; Oserend. R. P. *Fuel Processing Technology,* 2001, 71, 187). Previously, the inventor showed that polyols, produced directly from biomass carbohydrate polymers using catalytic hydrogenolysis, could subsequently be reduced by a concentrated HI solution when an added co-reducing agent such as $H_3PO_2$ or $H_3PO_3$ was present to rapidly transform incipient $I_2$ into HI (U.S. Pat. No. 5,516,960 (1996)). However, the $H_3PO_4$ byproduct was not easily regenerated, which with industrial sized plants could become a problematic waste (Robinson. J. M.; Herndon, P. T.; Holland, P. L.; Marrufo. L. D. "Regeneration and Recovery of Hydriodic Acid after Reduction of Polyols to Fuels", *Organ. Process Res. &. Dev.* 1999, 3(5), 352).

Thus, there is a need in the art for a readily regenerable system for electrochemical conversion of polyols from biomass to more useful hydrocarbon (HC) products such as combustible fuels.

SUMMARY OF THE INVENTION

The present invention provides a regenerable system for electrochemical conversion of polyols to hydrocarbon (HC) products, where the system comprises a coupled electrochemical process including a reduction of polyols to hydrocarbons or iodohydrocarbons and a concurrent oxidation of HI to $I_2$. This reaction is coupled to a secondary electrochemical reaction that converts $I_2$ back to HI via a oxidation of a metal from a reduced state to an oxidized state. The metal component of the system is then regenerated by reducing the spent metal from its oxidized state back to its reduced state so that the system can be run on a continuous basis. The metal component can be any metal or mixture of metal ions that have a proper reduction potential to effectively and efficiently convert the $I_2$ to HI.

The present invention also provides a regenerable system for electrochemical conversion of polyols to hydrocarbon (HC) products, where the system comprises a coupled electrochemical process including a reduction of polyols to hydrocarbons or iodohydrocarbons and a concurrent oxidation of HI to $I_2$. This reaction is coupled to a secondary electrochemical reaction that converts $I_2$ back to HI via a oxidation of a metal ion from a reduced state to an oxidized state, where the metal ion is selected from the group consisting of vanadium II ($V^{2+}$), Europium II ion ($Eu^{2+}$), and Titanium II ion ($Ti^{2+}$) and mixtures or combinations thereof. The metal component of the system is then regenerated by reducing the spent metal ion from its oxidized state back to its reduced state so that the system can be run on a continuous basis.

The present invention provides a method for generating hydrocarbon products from polyols including the step of contacting an aqueous solution of polyols with an electro chemical solution including HI in an amount sufficient to reduce the polyols to hydrocarbon or iodohydrocarbon products and iodine ($I_2$). This solution is then coupled electrochemically to a metal ion solution including metal ions in a reduced state to regenerate to the HI by reducing the iodine to HI. The spent metal ion solution is then electrochemically reduced to regenerate the reduced state ion solution. These coupled electrochemical reactions permit the continuous conversion of polyols to hydrocarbon and/or iodohydrocarbon products.

BRIEF DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
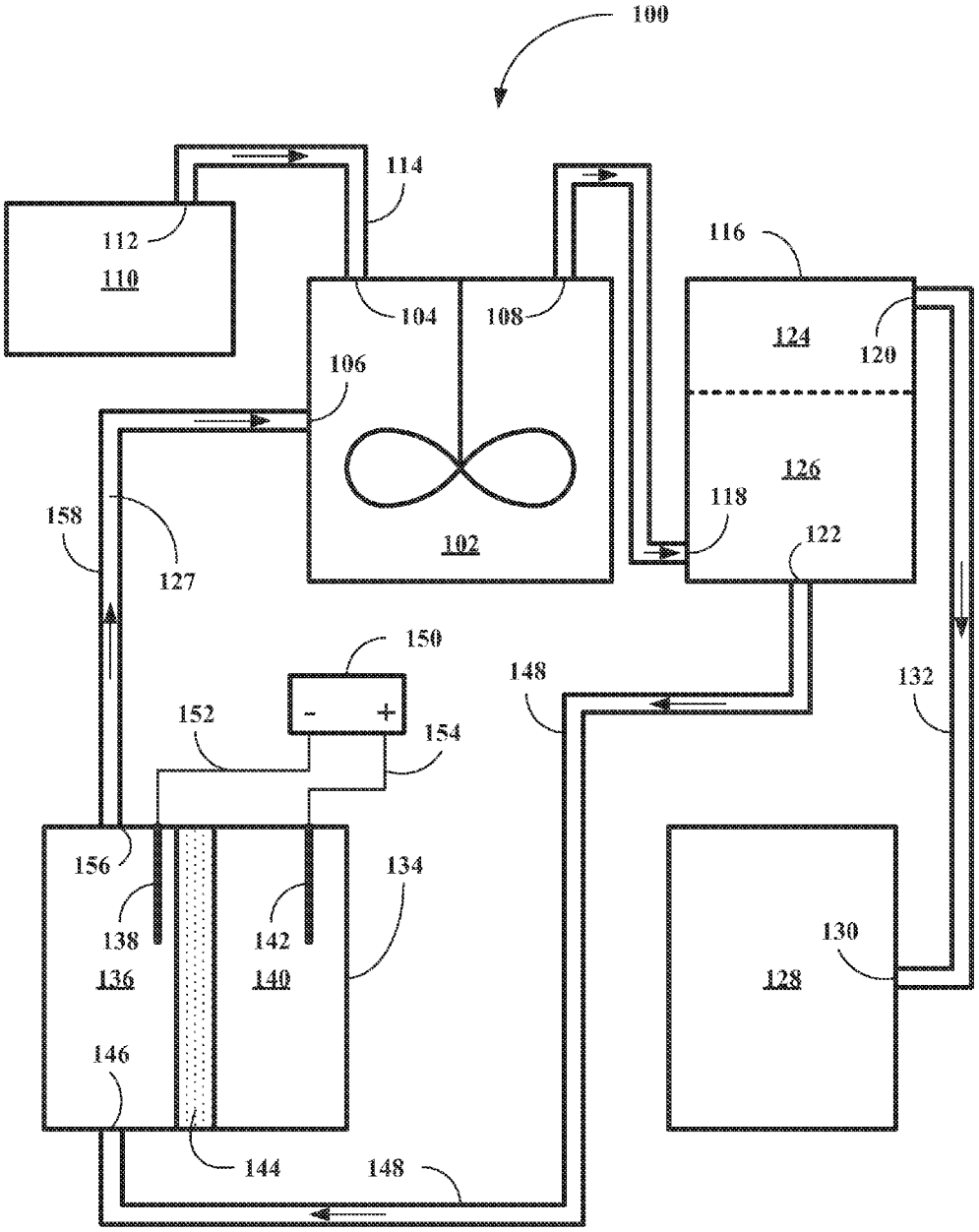
FIG. 1 depicts an embodiment of a batch, semi-continuous or continuous polyol reduction apparatus of this invention.

The inventor has found that HI solutions, together with reduced metal ions stable in acidic conditions and having the appropriate reduction potentials, are capable of removing incipient $I_2$ and providing hydrocarbon products and of being continuously regenerated so that the conversion process can be carried out on an continuous, semi-continuous, or periodically continuous basis. The inventor has found that vanadium II ($V^{2+}$), europium II ($Eu^{2+}$), and titanium II ($Ti^{2+}$) ions are suitable for the co-reducing component for the reduction of polyols by HI solutions, but capable of continuous operation via reduction of the oxidized state of the metal ions back to their reduced state. Table I shows their standard reduction potentials and our experimental reduction potentials in 0.1 M HI solution versus Ag/AgCl reference electrode.

TABLE I

Experimental Reduction Potentials in 0.1M HI

| Half Cell Rxn | E°(V) | E*(v) |
|---|---|---|
| $H_3PO_4 + 2e^- = H_3PO_3$ | −0.27 | −0.63 |
| $V^{3+} + e^- = V^{2+}$ | −0.26 | −0.89 |
| $Eu^{3+} + e^- = Eu^{2+}$ | −0.35 | −0.92 |
| $Ti^{3+} + e^- = Ti^{2+}$ | −0.37 | −0.61 |

Other potential redox system include indium III ($In^{3+}$) to indium II ($In^{2+}$), $In^{3+}$ to indium I ($I^{+}$), chromium III ($Cr^{3+}$) to chromium II ($Cr^{2+}$) and uranium IV ($U^{4+}$) to uranium III ($U^{3+}$).

It is known that multiple equivalents of these metal ions are required for each mole of polyols according to the following illustrative chemical reactions:

$$C_6(OH)_6H_8+5H_3PO_3+HI=C_6H_{13}I+5H_3PO_4+H_2O$$

$$C_6(OH)_6H_8+10V^{2+}+11HI=C_6H_{13}I+10V^{3+}+6H_2O$$

$$C_6(OH)_6H_8+9V^{2+}+9HI=1/2(C_{12}H_{22})+9V^{3+}+6H_2O$$

$$C_5(OH)_5H_7+9V^{2+}+9HI=C_8H_{11}I+9V^{3+}+5H_2O$$

In certain embodiments, a stoichiometric ratio of the metal ions in their reduced state to polyols is used to produce hydrocarbon products. In other embodiments, an excess of the metal ions in their reduced state is used to assure rapid and efficient chemical and electrochemical reactions to produce hydrocarbon products. In other embodiments, a 10% excess of the metal ions in their reduced state to polyols is used to further assure rapid and efficient chemical and electrochemical reactions to produce hydrocarbon products. As a result of the polyol reduction, a spent solution including substantially oxidized vanadium $V^{3+}$ ion and unreacted HI is formed. After the separation of organic products, the spent solution is circulated through an electrochemical cell reactor, where substantially all of the $V^{3+}$ ions are reduced to $V^{2+}$ ions, where the term substantially all means that 80% or more of the $V^{3+}$ ions are reduced to $V^{2+}$ ions. The electrochemical reaction converts $VI_3$ into $VI_2$ regenerating the $V^{2+}$ ions consuming $I_2$ and producing or regenerating HI and evolving $O_2$ at the anode according to a representative equation:

$$2V^{3+}+H_2O+I_2=2V^{2+}+2HI+1/2O_2$$

The overall redox strategy is illustrated below, where the reduction of polyols to HC is accomplished by the conversion of HI to $I_2$ which is in turn is coupled to an oxidation of $V^{2+}$ to $V^{3+}$ converting $I_2$ back to HI:

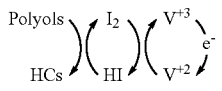

In the present invention, there is no waste byproduct produced, such as phosphoric acid. The HI/$V^{2+}$/$V^{3+}$ system can be used repeatedly and continuously. Some iodide content is temporarily removed as organic iodides, but is eventually recovered by elimination with base and by another efficient electro-hydrolysis technique upon the iodide salt (Robinson, J. M.; Mechalke, E. J.; Barber, W. C.; Holland. P. L.; Rogers. T. E. "Electrohydrolysis Recycling of Waste Iodide Salts into Hydriodic Acid for the Chemical Conversion of Biomass into Liquid Hydrocarbons." *J. Membrane Sci.* 2000, 179, 109).

The present coupled electrochemical system produces hydrocarbon products that can be used as hydrocarbon solvents or as hydrocarbon fuels. The ratios of light to heavy hydrocarbon products is controllable to some extent by controlling the dilution, temperature and pressure of the system. The amount of dimers (dimers use less reduction and further iodine recovery is required) can be increased by slight dilution. Pressure above ambient gives a higher boiling point than is otherwise achieved, and, in this manner, hydrocarbon monomers, pentene and hexene, and mixtures of dimers ($C_{10}$-$C_{12}$) and trimers ($C_{15}$-$C_{18}$) are produced from polyols penultimately derived from the carbohydrate polymers of biomass, i.e., hemicellulose and cellulose (Robinson. J. M.; Burgess, C. E.; Bently, M. A.; Brasher. C. D.; Horne, B. O.; Lillard, D. M.; Macias, J. M.: Mandal, H. D.; Mills, S. C.; O'Hara, K. D.; Pon, J. T.; Raigoza. A. F.: Sanchez, E. H.; and Villarreal. J. S. "The use of catalytic hydrogenation to intercept carbohydrates in a dilute acid hydrolysis of biomass to effect a clean separation from lignin", *Biomass and Bioenergy,* 2004, 25(5) 473-483). Further hydrogenation transforms these alkenes and cyclic alkenes into the solvents pentane and hexane and increases the blending octane number of the dimers, etc. Biomass is cleanly fractionated by catalytic hydrogenolysis in dilute $H_3PO_4$ with Ru catalysts. Starch similarly provides polyols without lignin byproducts and at much lower temperature. The present invention can thus be used to produce hydrocarbons having between about four carbon atoms and about 40 carbons atoms, with one or more of the carbon atoms replaced by one or more oxygen atoms, where the hydrocarbons are alkanes and alkenes. It is assumed that all iodohydrocarbons having already been converted to their corresponding alkanes or alkenes; otherwise, the hydrocarbons products also include iodohydrocarbons.

Initial transformation of readily available $V_2O_5$ ($V^{5+}$) to $V^{2+}$ ions requires more electrochemical reduction equivalents then does the simple recycle of $V^{3+}$ to $V^{2+}$, but both are accomplished in the same manner. The bulk electrolysis is conducted in HI catholyte under argon and with a graphite electrode. The anode compartment is separated by proton exchange membrane such as Nafion 350. The $HIO_3$/$HIO_4$ anolyte and modified stainless steel anode used were the same as forwarded by Genders (see U.S. Pat. No. 5,520,793). Other suitable oxidation half cells can also be used for the anode.

The $VI_2$/HI solution can be stored under argon. Only between about 80 and about 90% of the $V^{3+}$ ions in the spent solution need to be reduced to $V^{2+}$ ions for effective continuous operation, which is accomplished with high cell efficiency using only a flat plate electrode. In certain embodiments, diluted solutions are used to reduce membrane fouling. The coupled electrochemical system of this invention can also be used to convert poly hydroxy carboxylic acids to organic lactones useful as fuel oxygenate additives.

In certain embodiments, the electrochemical cell temperature is between about 20° C. and 80° C. In other embodiments, the electrochemical cell temperature is greater than (>) 20° C. and less than (<) 80° C. Cell efficiency is increased somewhat with increased temperature, but membrane life is shortened. Thus, the system temperature is adjusted to simultaneously increase efficiency but to maintain membrane life.

EXPERIMENTS OF THE INVENTION

Electrochemical Preparation of $V^{2+}$ (H-Cell)

Bulk electrolysis of $V^{+5}$ to $V^{+2}$ carried out under Ar.

$V_2O_5$ (22.76 g, 0.125 mol) (from Alfa Aesar, fine powder) was dissolved in 60 mL of 57 wt. % HI (0.046 mol) aqueous solution for the catholyte solution. The anolyte solution (60 mL) included a 10 wt. % iodic acid ($HIO_3$) solution with the periodic addition of a 1 wt. % periodic acid ($HIO^4$) solution to ensure clean reaction start. Graphite rods were the working cathode with a Ag/AgCl reference electrode with a Platinum coil wire counter electrode in the anode compartment of a glass "H-cell" separated by a proton exchange membrane (Nafion 350, 5 cm). The electro synthesis of $VI_2$ was achieved with an EG&G potentiostat applying 0.98 A constant current. The resulting voltage averaged approximately −0.6V. The reduction took 19 hr because of low current density (~0.2 A/cm$^2$) across the membrane, the small surface area of Pt anode (0.2 cm$^2$) and the size of carbon cathode rods (28 cm$^2$). The prepared $VI_2$/HI solution was stored under Ar to avoid oxidation by air.

Bench Pilot Scale Electrochemical Reduction of $V_2O_5$ to $VI_2$ (MP Flow Cell)

$V_2O_5$ (254.91 g, 1.4 mol) was dissolved in warm 57 wt. % HI (~1 L) in catholyte flask (2 L). The anolyte used was a mixture of 10 wt. % $HIO_3$ and 1 wt. % $HIO_4$. The electrochemical reduction is conducted in a MP Flow Cell (Electro-Cell AB) membrane reactor with graphite plate as cathode and Ir coated $TiO_2$ Diffusion Stable Anode (DSA) as anode with a Nafion 350 cation exchange membrane (Active surface area 100 cm$^2$) as the compartment separator. Catholyte and anolyte solutions were pumped (Iwaki Walchem WMD-30LFY) through Teflon tubing connecting the entire system. The flow rates were adjusted to between 0.5 and 1.0 gal/min (gallons per minute) and valves were also adjusted to balance the pressure (isolated digital pressure gauges, Cole Parmer) and maintained at a balanced pressure. In certain embodiments, a slightly higher pressure on the anolyte side may be desired to prevent large amounts of HI from migrating to the anode side.

A constant current electrolysis was then conducted at 25 A (0.25 A/cm$^2$) by means of a Xantrex XHR DC power supply. Applied voltage, temperatures, and coulombs consumed (Rapid Power Technologies coulometer) were monitored over time. The temperatures of the catholyte and anolyte reservoirs were measured using a Teflon coated thermocouples. The starting temperature was increased by heating mantles applied to the reservoirs. The reaction took about 1.5 hr and eventually changed from the greenish blue solution to the violet color of a $V^{2+}$ solution.

Biomass to Hydrocarbon Reaction

Sorbitol (7.69 g, 41 mmol), an example of a biomass derived polyol reactant, was placed into somewhat diluted about 3 molar hydriodic acid (265 mL) solution of $VI_2$ (0.577 mol) from a previous electrolytic reduction. Water (153 mL) was fractionally distilled to increase both the concentration of HI (to about 6.93 molar) and the temperature of the reaction to about 131° C. The reaction was then refluxed under Argon for 6 hr. The aqueous distillate contained some steam distilled organic compounds that were extracted with an extraction solvent such a $CH_2Cl_2$. The acid and vanadium mixture remaining in the reaction pot was then diluted with water (80 mL) and extracted with $CH_2Cl_2$. The extracts were dried over $Na_2SO_4$ and the solvent removed in vacuuo to give 1.76 g of organic products from the reaction pot and 4.422 g of products from the distillate. GC/MS analyses were carried out on the product fractions using a Hewlett Packard 5890 Series II Gas Chromatograph coupled to a HP 5988A Mass Spectrometer. A nonpolar capillary column (HP-1, 0.2 mm ID, 12.5 m with 0.33 μm film of crosslinked methyl silicone gum) was programmed to run for 1 minute at 26° C., then increased to 5° C./min. for 3 minutes followed by a rate of 10° C./min. until a temperature of 280° C. was reached, and then, the column was held at constant temperature for 5 minutes. The extraction solvent can be a low boiling point alkane such as pentane, hexane, heptane, octane or other similar liquid low boiling point alkane, low boiling point halogenated hydrocarbons such as dichloromethane ($CH_2Cl_2$), chloroform ($HCl_3$) carbon tetrachloride ($CCl_4$), dichloroethane, dichloroethylene, or other low boiling halogenated hydrocarbons, or any other water immiscible, low boiling point organic solvent or mixtures or combination thereof.

Using this procedure, several isomers of the general formulas shown in the Table II were separated and identified by their mass spectra. The area percents of all identical mass isomers were summed in order to simplify calculations for mole percent yields for several isomer groups. For example, the $C_{12}$ fraction may contain up to 70 isomers boiling between 180-210° C. Small amounts of hexene and hexanol were also found. No corrections were made for any detector sensitivity differences between these products. Total yields are essentially quantitative, but some of the volatile components are lost during solvent removal to obtain reasonably accurate weights of products. Several reactions conducted in this manner averaged about 60 wt. % halocarbons and 40 wt. % hydrocarbons.

TABLE II

| Temperature and Product Yields | | | | | | | |
|---|---|---|---|---|---|---|---|
| T ° C. | $C_6H_{12}$ | $C_6H_{13}I$ | $C_{12}H_{20-22}$ | $C_6H_{12}I_2$ | $C_{18}H_{30-34}$ | $C_{24}H_{38-42}$ | Total |
| 131 | 3.2% | 52.9% | 16.3% | 2.5% | 19.0% | 0.0% | 93.9% |

UV spectroscopy was used to measure the [$V^{3+}$] and [$V^{2+}$] before and after the reaction. The vanadium, now mostly $V^{3+}$ with some excess $V^{2+}$, remains in the aqueous layer from the polyols reaction and is electrochemically regenerated in the HI solution directly.

UV Analysis of $V^{3+}$ and $V^{2+}$

A calibration plot for $V^{3+}$ was performed by UV spectroscopy on a serial of dilutions of a $VCl_3$ (Aldrich Chemical Co.) solution in pure water. Measurements at 428 nm afforded a linear response up to [1.25] $V^{3+}$. The concentration of solutions of $V^{3+}$ ions in HI were thus measured using the linear calibration plot of absorbance versus concentration. The concentration of electrolyzed $V^{2+}$ solution was calculated by difference in the peaks for $V^{3+}$ and $V^{2+}$ species by allowing a portion of the solution to oxidize to the $V^{3+}$ state by aeration and the UV spectrum is then taken to measure the total amount of vanadium in solution. When a sample aliquot of the HI/$V^{3+}$/$V^{2+}$ solution is appropriately diluted to be measured with the UV-VIS method, the slight acidity or the nature of the counter ion (chloride versus iodide ions) apparently had no effect on this analytical method.

Electrochemical Recycling of $V^{3+}$ and $V^{2+}$

After extraction, the aqueous layer from a biomass reaction is a solution of slightly diluted mostly $V^{3+}$ ions and HI—the spent solution. The spent solution was used as a new catholyte in an electrochemical reactor for converting a substantially all of the $V^{3+}$ ions to $V^{2+}$ ions. Thus, $V^{3+}$ (0.5047 mol) was electrolyzed in an H-cell at 1.2 V and 1.0 A for 8.42 hr. The yellowish green color ($V^{3+}$) solution turned into violet color ($V^{2+}$) solution at the end point of the reaction. The end point was also observed with the evolution of hydrogen gas at the cathode.

Elevated Boiling Point Reaction

When a 50% aqueous HI solution was used at ambient pressure without distillation, the organic reaction of polyols does not initiate because a sufficiently high temperature is not achieved by simple reflux. In contrast, when the same solution is pressurized in a Teflon lined steel reactor (Berghof) and heated to a temperature above 127° C., the organic reaction does initiate and the polyols are quickly transformed to the immiscible hydrocarbon and halocarbon products. The benefit of using a somewhat diluted HI solutions and conducting the reaction under pressure is that more hydrocarbons are formed directly and subsequently, less iodide recovery (from organohalide compounds) is necessary.

DETAILED DESCRIPTION OF THE DRAWINGS

Referring now to FIG. 1, a block diagram of an embodiment of an apparatus of this invention, generally 100, for reducing polyols to hydrocarbons is shown to include a stirred tank reactor 102 having a polyol feed inlet 104, a reducing reagent inlet 106 and a crude product outlet 108. The polyol feed inlet 104 is connected to a polyol feed vessel 110 including a polyol outlet 112, where the polyol outlet 112 is connected to the polyol feed inlet 104 via a polyol conduit 114. The stirred tank reactor 102 is adapted to bring the polyol feed and the reducing reagent into electrochemical contact so that polyols are converted into hydrocarbons or iodohydrocarbons, HI is converted to $I_2$ and reduced metal ions are oxidized regenerating HI from $I_2$ until the reaction is complete or complete to a desired degree. The reactor 102 can be heated, can be pressurized and can be run in a batch mode, a semi-continuous mode or a continuous mode. The crude product from the reactor 102 is forwarded to a separation tank 116 having a crude product inlet 118 via a crude product conduit 109, an organic phase outlet 120 and an aqueous phase outlet 122. The separation tank 116 is adapted to allow separation of an organic phase from the aqueous reducing phase. The separation can be added by the addition of anti-foaming agents or other agents that assist in phase separation so that the phases can be separately withdrawn without substantial phase mixing at the outlets.

The separator 116 is adapted to support an organic phase 124 and an aqueous phase 126. The organic phase 124 is forwarded through the organic phase outlet 120 to a distillation system 128 through an organic phase inlet 130 via an organic phase conduit 132. The distillation system 128 is designed to separate the organic phase into products based on their molecular weight and chemical composition. The distillation system 128 can also include reactors for converting iodohydrocarbons into their corresponding hydrocarbons and recovering the iodine, generally as HI for recycle to the aqueous reducing solution. The distillation system 128 can also include hydrogenation units for reducing olefin contents to a desired level. The separated hydrocarbons can include low molecular weight alkanes or alkenes for use as solvents, fuel grade alkanes and alkenes, and oil grade alkanes and alkenes or any other hydrocarbon product. Moreover, if the feed includes polyol-acids, then the hydrocarbons can include lactones, which can act as oxygenate additives for fuels for internal combustion engines.

The aqueous phase 124 is forwarded through the aqueous phase outlet 122 to an electrochemical cell system 144. The cell system 134 includes a catholyte compartment 146 having a cathodic electrode 148 and an anolyte compartment 150 having an anodic electrode 152 separated by an ion permeable membrane 154. The aqueous phase 124 enters the catholyte compartment 136 through an aqueous phase inlet 156 via a organic phase conduit 158 connected to the aqueous phase outlet 122. In the electrochemical cell 134, the spent aqueous phase 124 including a substantial portion of metal ions in their oxidized state, e.g., $V^{3+}$ for a vanadium coupled system, while in the anolyte compartment, other ions are oxidized to provide the electrons for reducing the metal ions in the catholyte compartment, which can be any ion capable of reducing the metal ions in the spent solution, e.g., $V^{3+}$ to $V^{2+}$. The electrodes 138 and 142 are connected to a battery or other power supply 160 via wires 162 and 164, respectively, which provides the power necessary for converting a substantial portion of the metal ions from their oxidized state to their reduced state and to convert any $I_2$ to HI to regenerate the reducing solution 127. Once the reducing solution or reagent has been regenerated, greater than or equal to about 80% of the metal ions are now in their reduced state, the reducing reagent is forwarded through a reducing reagent outlet 166 to the reducing reagent inlet 106 of the reactor 102 via a reducing reagent conduit 168. The conduit 158 may also be connected via valves to a source of metal ions and a HI solution for addition (not shown) during a continuous operation to account for system losses.

Figure 2:
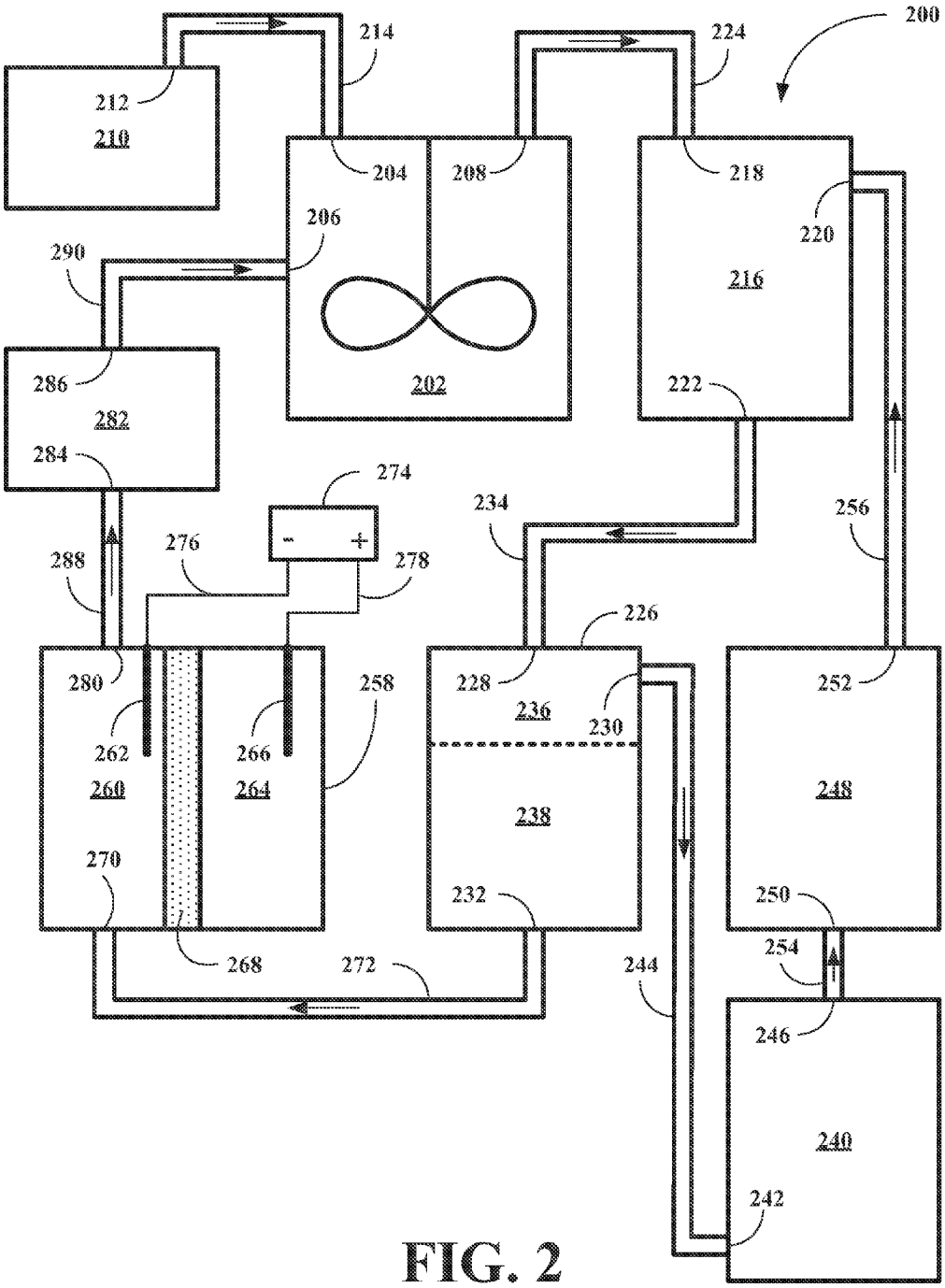
FIG. 2 depicts another embodiment of a batch, semi-continuous or continuous polyol reduction apparatus of this invention.

Referring now to FIG. 2, a block diagram of another embodiment of an apparatus of this invention, generally 200, for reducing polyols to hydrocarbons is shown to include a stirred tank reactor 202 having a polyol feed inlet 204, a reducing reagent inlet 206 and a crude product outlet 208. The polyol feed inlet 204 is connected to a polyol feed vessel 210 including a polyol outlet 212, where the polyol outlet 212 is connected to the polyol feed inlet 204 via a polyol conduit 214. The crude product from the reactor 202 is forwarded to a holding tank 216 having a crude product inlet 218, an extraction solvent inlet 220 and a holding tank outlet 222 through the outlet 208 and the inlet 218 via a crude product conduit 224. The holding tank 216 is adapted to hold crude product and mix the crude product with an extraction solvent to aid in product separation from the spent aqueous electrolytic solution. The holding tank 216 is also adapted to act as a primary staging area for the crude product and is generally stirred at a high rate to insure efficient solvent extraction and to insure that the solvent/crude product is all forwarded through the tank outlet 222 to a separation tank 226 having a crude product inlet 228, an organic phase outlet 230 and an aqueous phase outlet 232. The crude product inlet 228 is connected to the crude product outlet 222 of the holding tank 216 via a crude product conduit 234. The separation tank 226 is adapted to allow separation of an organic phase from the aqueous reducing phase. The separation can be added by the addition of anti-foaming agents or other agents that assist in phase separation so that the phases can be separately withdrawn without substantial phase mixing at the outlets.

The separator 226 is adapted to support an organic phase 236 and an aqueous phase 238. The organic phase 236 is forwarded through the organic phase outlet 230 to a distillation system 240 through an organic phase inlet 242 via a organic phase conduit 244. The distillation system 240 also includes an extraction solvent outlet 246 is designed to recover the extraction solvent and to separate the crude product into final products based on their molecular weights and chemical compositions. The distillation system 240 can also include reactors for converting iodohydrocarbons into their corresponding hydrocarbons and recovering the iodine, generally as HI for recycle to the aqueous reducing solution. The distillation system 240 can also include hydrogenation units for reducing olefin contents to a desired level. The separated hydrocarbons can include low molecular weight alkanes or alkenes for use as solvents, fuel grade alkanes and alkenes, and oil grade alkanes and alkenes such as lubricating oils or any other hydrocarbon product. Moreover, if the feed includes polyol-acids, then the hydrocarbons can include lactones, which can act as oxygenate additives for fuels for internal combustion engines. The separated extraction solvent is forwarded through the extraction solvent outlet 246 to an extraction solvent holding tank 248 including a recycle extraction solvent inlet 250 and an extraction solvent return outlet 252, where the recycle extraction solvent inlet 250 is connected to the extraction solvent outlet 246 via a recycle extraction solvent conduit 254. The extraction solvent holding tank 248 can also include a free solvent inlet (not shown) for making up for solvent loss in the process. From the extraction holding tank 248, the extraction solvent is supplied to the extraction solvent inlet 220 via an extraction supply conduit 256.

The aqueous phase 238 is forwarded through the aqueous phase outlet 232 to an electrochemical cell system 258. The cell system 258 includes a catholyte compartment 260 having a cathodic electrode 262 and an anolyte compartment 264 having an anodic electrode 266 separated by an ion permeable membrane 268. The aqueous phase 238 enters the catholyte compartment 260 through an aqueous phase inlet 270 via a organic phase conduit 272 connected to the aqueous phase outlet 232. In the electrochemical cell 258, the spent aqueous phase 238 including a substantial portion of metal ions in their oxidized state, e.g., $V^{3+}$ for a vanadium coupled system, while in the anolyte compartment, other ions are oxidized to provide the electrons for reducing the metal ions in the catholyte compartment, which can be any ion capable of reducing the metal ions in the spent solution, e.g., $V^{3+}$ to $V^{2+}$. The electrodes 262 and 266 are connected to a battery or other power supply 274 via wires 276 and 278, respectively, which provides the power necessary for converting a substantial portion of the metal ions from their oxidized state to their reduced state and to convert any $I_2$ to HI to regenerate the reducing solution.

Once the reducing solution or reagent has been regenerated (greater than or equal to about 80% of the metal ions are now in their reduced state), the reducing reagent is forwarded through a reducing reagent outlet 280 to a reducing reagent holding tank 282 having a regenerated reagent inlet 284 and a supply reagent outlet 286 through the regenerated reagent inlet 284 via a reducing reagent conduit 288. The holding tank 282 may also be connected to a source of metal ions and a HI solution for addition (not shown) during a continuous operation to account for system losses. The reagent is then forwarded to the reagent inlet 206 of the reactor 202 from the outlet 286 via a reducing reagent feed conduit 290.

The holding tanks 216, 248 and 282 are adapted to regulate the flow of reagents through the system during continuous or semi-continuous operations.

In both of the embodiments of FIGS. 1 and 2, the system are not show with valving, pumps, controllers, temperature sensors, pressure sensors, heating cooling jackets, regulators or system control units; however, one of ordinary skill in the art would recognize that such systems would generally required such addition hardware and software for actual semi-commercial or commercial operations and its is within such skilled artisans ordinary skill to equip the system with such additional hardware and software.

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

I claim:

1. A system of converting polyols to hydrocarbons comprising:

a reactor subsystem including:

an aqueous redox solution reservoir (arsr 136) including:

a redox solution outlet (rso 156), and a redox solution conduit (rsc 158), an aqueous polyol solution reservoir (apsr 110) including:

a polyol solution outlet (pso 112), and a polyol solution conduit (psc 114), and a redox reactor (rr 102) including:

a redox solution inlet (rsi 106), a polyol solution inlet (psi 104), a crude product outlet (cpo 108), and a crude product conduit (cpc 109), where the redox solution conduit (rsc 158) connects the redox solution outlet (rso 156) to the redox solution inlet (rsi 106), where the polyol solution conduit (psc 114) connects the polyol solution outlet (pso 112) to the polyol solution inlet (psi 104), wherein the redox solution comprises hydrogen iodide (HI) and reduced metal ions, wherein the polyol solution and the redox solution are contacted in the redox reactor to form a crude product under conditions of temperature, pressure, resonance time, and dilution to: (a) convert a portion of polyols in the polyol solution into their corresponding hydrocarbons and/or iodohydrocarbons and a first portion of the HI into $I_2$ and (b) concurrently convert $I_2$ back into HI and the reduced metal ions into their corresponding oxidized metal ions, and where the reduced metal ions are selected from the groups consisting of vanadium II ($V^{2+}$), europium II ($Eu^{2+}$), titanium II ($Ti^{2+}$), indium II ($In^{2+}$), indium I ($In^{+}$), chromium II ($Cr^{2+}$) and uranium III ($U^{3+}$) and the oxidized metal ions are selected from the group consisting of vanadium III ($V^{3+}$), europium III ($Eu^{3+}$), titanium III ($Ti^{3+}$), indium III ($In^{3+}$), chromium III ($Cr^{3+}$) and uranium IV ($U^{4+}$), a separation subsystem including:

a separation vessel including:

a crude product inlet, an organic phase outlet, an organic phase conduit, an aqueous phase outlet, an aqueous phase conduit, and a hydrocarbon fractionation component including:

an organic phase inlet, where the crude product conduit connects the crude product outlet to the crude product inlet, where the organic phase conduit connects the organic phase outlet to the organic phase inlet, where the separation vessel separates the crude product into an organic phase and an aqueous phase, where the organic phase comprises the corresponding hydrocarbons and/or iodohydrocarbons, and where the aqueous phase comprises a spent redox solution comprising $I_2$, HI, and the oxidized metal ions, and a regeneration subsystem including:
an electrochemical cell including:
an aqueous solution inlet,
the redox solution outlet,
an anolyte compartment including:
a cathode,
a catholyte compartment including:
an anode,
an ion permeable member separating the anolyte and catholyte compartments, and
a battery connected to the anode and cathode by wires,
where the aqueous phase conduit connects the aqueous phase outlet to the aqueous phase inlets, where the cell treats the aqueous phase under electrochemical conditions to substantially convert the oxidized metal ions to their corresponding reduced metal ions, and where the catholyte compartment comprises the redox solution reservoir.

2. The system of claim 1, wherein the reactor subsystem further includes a fresh redox solution reservoir having a fresh redox solution outlet connect to fresh redox solution inlet of the redox reservoir.

3. The system of claim 1, further comprising:
an iodine recovery system, where iodohydrocarbons are converted to their corresponding hydrocarbons and HI prior to fractionation and the HI is recovered and returned to the cell prior to regeneration.

4. The system of claim 1, wherein the redox solution comprises HI and a metal ion in a reduced state, wherein the spent redox solution comprises HI, $I_2$ and the metal ion in an oxidized state and wherein the regenerated redox solution comprises HI and a substantial amount of the metal ion in its reduced state.

5. The system of claim 4, wherein the substantial amount of the metal ion in its reduced state comprises greater than or equal to about 80% of the metal ions from the spent redox solution are in their reduced state.

6. The system of claim 1, wherein the hydrocarbons comprise a hydrocarbon having between about four carbon atoms and about 40 carbons atoms, with one or more of the carbon atoms replaced by one or more oxygen atoms, where the hydrocarbons are alkanes and alkenes.

7. The system of claim 1, wherein the hydrocarbons comprise a hydrocarbon and/or iodohydrocarbon having between about four carbon atoms and about 40 carbons atoms, with one or more of the carbon atoms replaced by one or more oxygen atoms, where the hydrocarbons are alkanes and alkenes.

8. The system of claim 1, wherein the hydrocarbons comprise pentene and hexene, and mixtures of dimers ($C_{10}$-$C_{12}$) and trimers ($C_{15}$-$C_{18}$).

9. The system of claim 1, wherein the polyol solution comprises a biomass derived polyol solution.

10. The system of claim 1, wherein the separation subsystem further includes a solvent reservoir adapted to introduce an extraction solvent into the separator vessel to assist in phase separation.

11. The system of claim 1, further comprising
a redox solution holding tank including:
a holding tank inlet,
a holding tank, outlet, and
a holding tank conduit,
where the holding tank conduit connects the redox solution outlet to the holding tank inlet, where the redox solution conduit connects the holding tank outlet to the redox solution inlet, and where the holding tank comprises the redox solution reservoir.

* * * * *